US007765633B2

(12) United States Patent
Zen

(10) Patent No.: US 7,765,633 B2
(45) Date of Patent: Aug. 3, 2010

(54) BROOM PROVIDED WITH PROTECTIVE CASING

(75) Inventor: Michele Zen, Cassola (IT)

(73) Assignee: ESSEPLAST S.p.A, Romano d'Ezzelino (Vicenza) (IT)

( * ) Notice: Subject to any disclaimer, the term of this patent is extended or adjusted under 35 U.S.C. 154(b) by 965 days.

(21) Appl. No.: 11/580,096

(22) Filed: Oct. 12, 2006

(65) Prior Publication Data

US 2007/0113364 A1 May 24, 2007

(30) Foreign Application Priority Data

Oct. 14, 2005 (IT) ..... MI2005A1936

(51) Int. Cl.
*A47B 17/04* (2006.01)

(52) U.S. Cl. ..... 15/184; 15/169

(58) Field of Classification Search ..... 15/184, 15/169, 168, 171; 206/36.1, 15.2, 15.3; *A47B 17/04; A46B 9/10*

See application file for complete search history.

(56) References Cited

U.S. PATENT DOCUMENTS

| | | | | |
|---|---|---|---|---|
| 857,615 | A * | 6/1907 | Gasque | 15/175 |
| 1,372,014 | A * | 3/1921 | Entwistle | 15/169 |
| 1,814,201 | A * | 7/1931 | Wingard | 15/171 |
| 6,606,756 | B2 * | 8/2003 | Fernandez | 15/111 |

* cited by examiner

*Primary Examiner*—Monica S Carter
*Assistant Examiner*—Stephanie Newton
(74) *Attorney, Agent, or Firm*—Bucknam and Archer

(57) ABSTRACT

A broom (10) having a stick (20) insertable on a top side (11') of a shaped batten (11) from the bottom side (11") of which there extend bristles (12) adapted for sweeping surfaces. The broom (10) is provided with a casing (30) made in the shape of a shell, shaped so that in a first lowered position, it covers the bristles by at least a portion of the length thereof, and in a second raised position, it allows the use of the broom for sweeping.

9 Claims, 5 Drawing Sheets

20
10
23
25
21
34
33
30
31
32
36
27
13
14
24
11'
11
11"
12
32

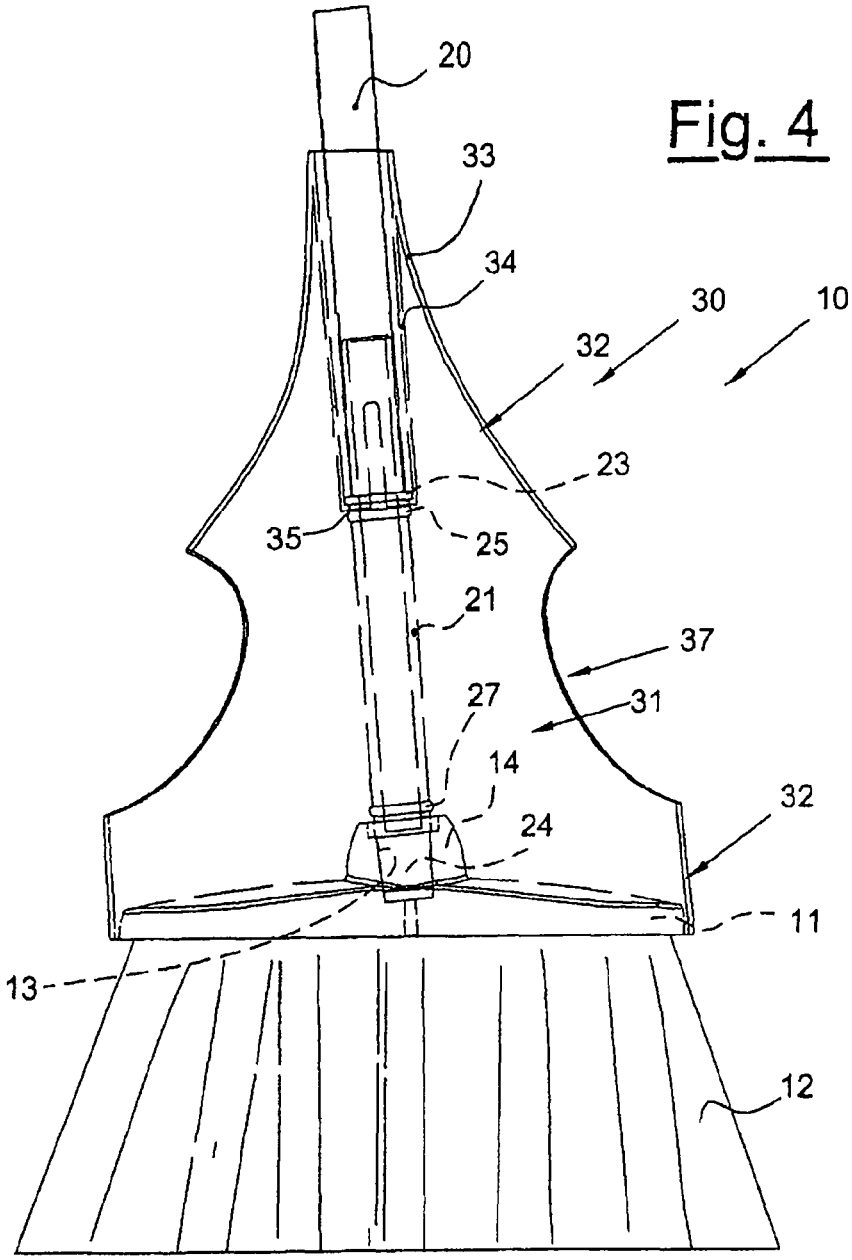
Fig. 4
Fig. 5
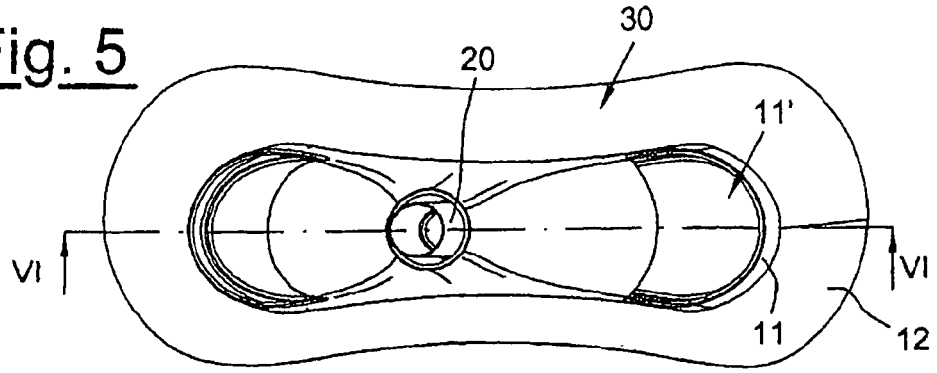

20
10
34
33
23
22
25
36
32
30
35
26
21
31
37
37
14
27
13
24
11
12

BROOM PROVIDED WITH PROTECTIVE CASING

BACKGROUND OF THE INVENTION

The present invention relates to a broom provided with protective casing.

Among household articles present in any house, the broom is always envisaged, in particular of the type comprising bristles attached to a batten adapted for receiving a stick or a handle. According to uses, the various components may be of different materials and in particular in almost all brooms, the bristles are made of resilient plastic material so as to bend to better capture and remove dirt.

When a broom is not in use or while cleaning, between one use and the next, the broom is frequently arranged against a wall resting on the bristles. In this condition, the broom often remains even for a long period of time, causing a permanent deformation of the bristles, and eventually resulting in the broom becoming unusable.

BRIEF SUMMARY OF THE INVENTION

The applicant has therefore felt the need to provide protection for the bristles of a broom which will allow long preservation thereof.

The object of the present invention therefore is to provide a broom having bristle protection for the periods of non-use of the broom, which will overcome the problem of early deformation of the bristles of the broom.

Another object of the present invention is to overcome the disadvantages of the prior art brooms by providing an easy to use broom.

Another object of the present invention is to overcome the disadvantages mentioned above in a very simple, inexpensive and particularly functional manner.

In view of the above objects, according to the present invention, a broom is provided with a protective casing having the shape of a shell, shaped so that in a first lowered position it covers the bristles of the broom by at least a portion of the length thereof, and in a second raised position it allows the use of the broom for sweeping.

BRIEF DESCRIPTION OF THE DRAWINGS

The structural and functional features of the present invention and its advantages as compared to the known art will appear from an analysis of the following description, made with reference to the annexed drawings, which show a broom provided with protective casing according to the innovative principles of the invention itself. In the drawings:

FIG. 4 is a front elevational view partly in cross-section of the broom provided with protective casing in the raised position, ready to use;

FIG. 5 is a plan view of the broom of FIG. 4;

DETAILED DESCRIPTION OF THE INVENTION

Figure 1:
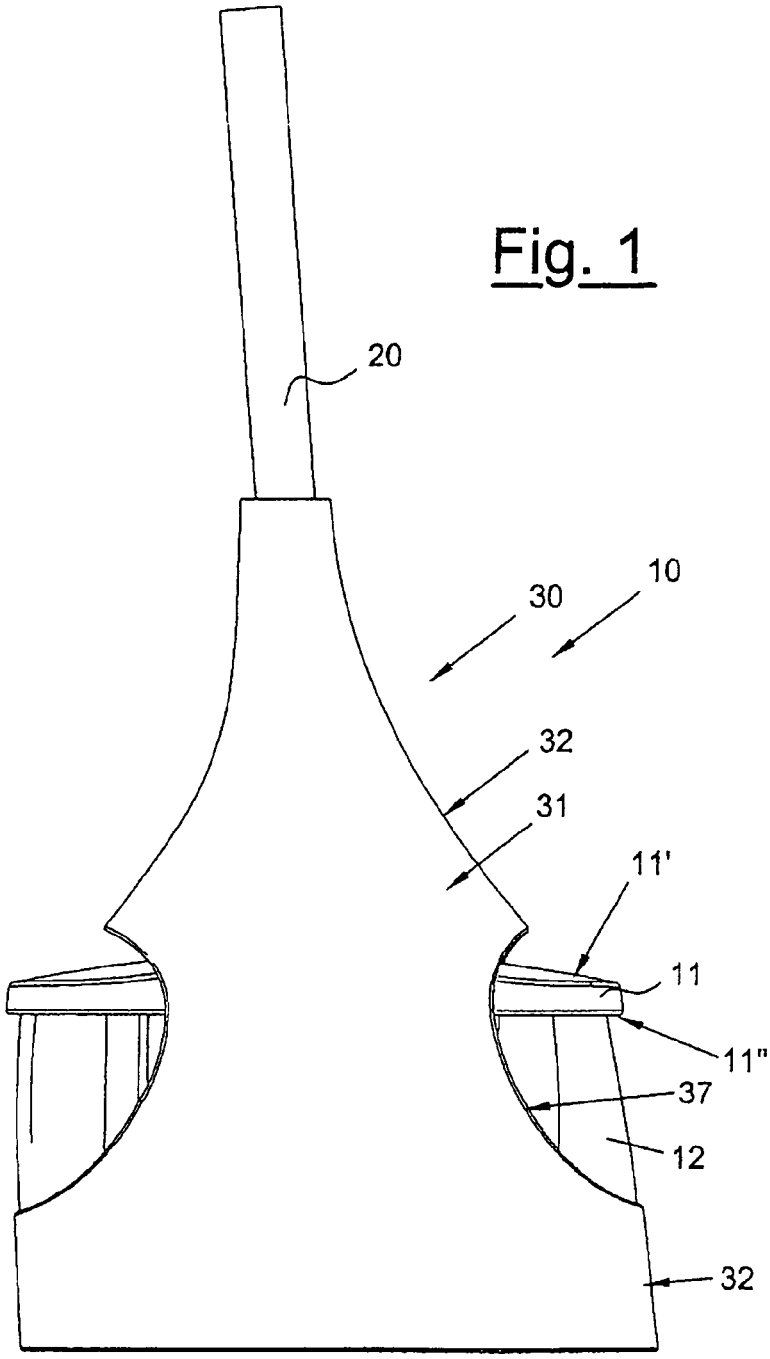
FIG. 1 is a front elevational view of the broom provided with a protective casing according to the present invention, in the lowered protection position.
Figure 2:
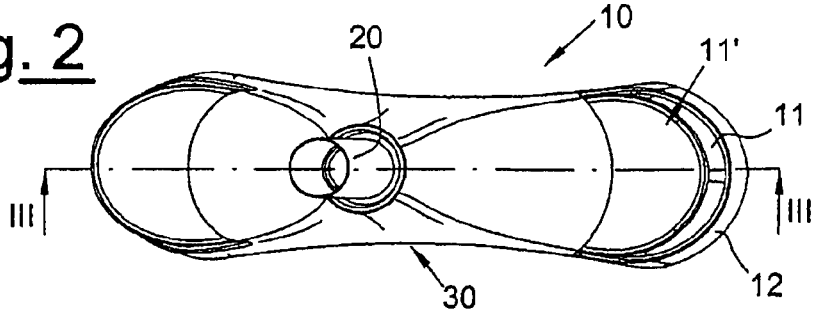
FIG. 2 is a plan view of the broom of FIG. 1.
Figure 3:
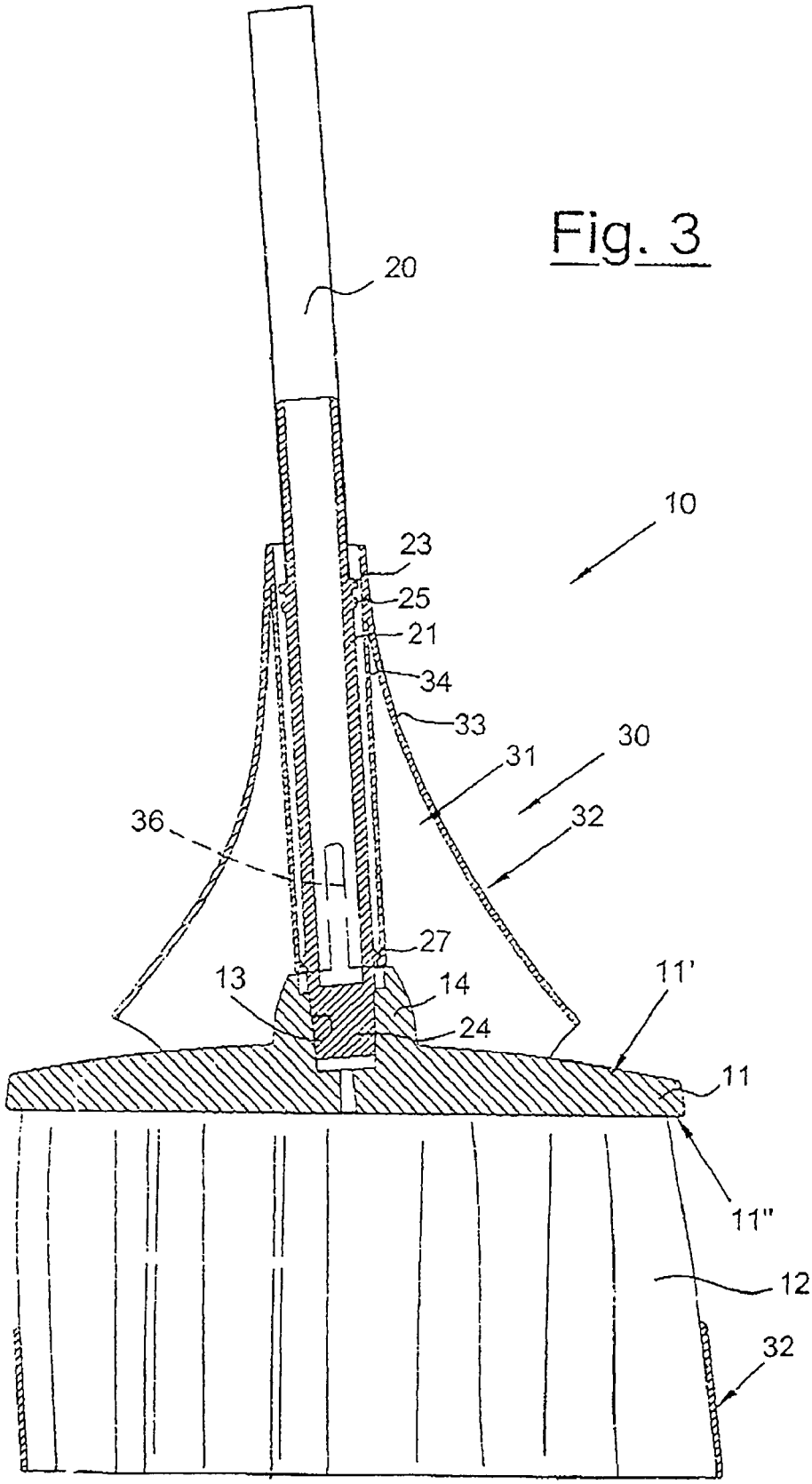
FIG. 3 is a cross-sectional view of the broom of FIG. 2 taken along line III-III of FIG. 2.
Figure 6:
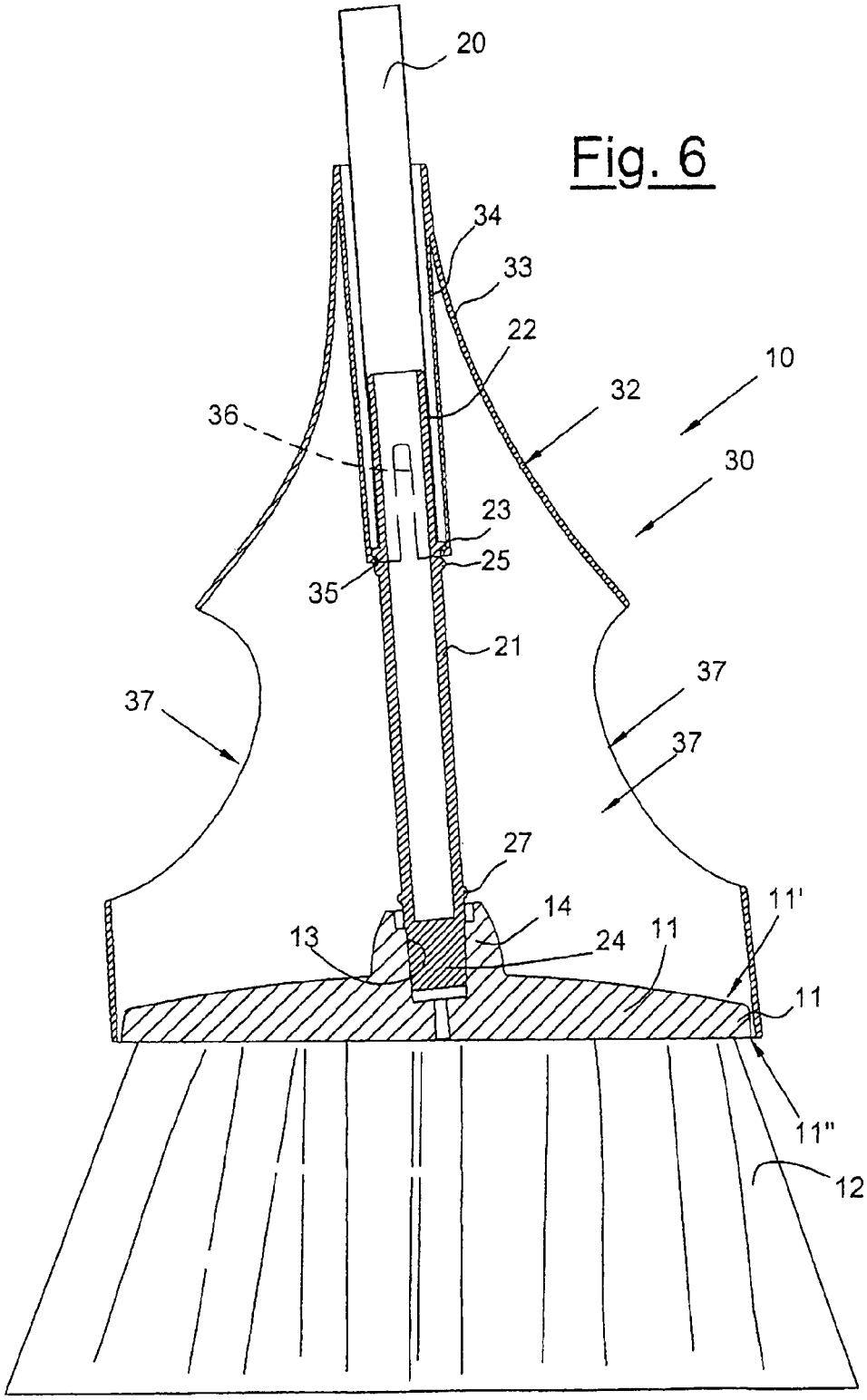
FIG. 6 is a cross-sectional view of the broom of FIG. 5 taken along line VI-VI of FIG. 5.

Referring to FIGS. 1 to 6, a broom 10 according to the present invention comprises a stick or handle 20 insertable on a top side 11' of a shaped batten 11 from the bottom side 11" of which there extend bristles 12 adapted for sweeping surfaces.

Stick 20 is formed in a tubular shape and is inserted on batten 11 by the interposition of a sleeve 21 having a first end 22 adapted for receiving a portion of stick 20 up to the point where an annular abutment 23, extending circumferentially from the sleeve, acts as a stop. A second end 24 of sleeve 21 opposite to first end 22 is threaded so as to be easily inserted into a corresponding threaded seat 13 provided in a collar 14 protruding in central position from the top side 11' of batten 11.

Externally to the broom and slideably received on sleeve 21, there is provided a casing 30 made in the shape of a shell formed of a resilient material but with limited flexibility, shaped so that in a first lowered position it covers the bristles by at least a portion of the length thereof, and in a second raised position, it allows the use of the broom for sweeping. Casing 30 in particular is provided so as to cover the bristles, for example in case they are soft and flexible, by the entire length thereof, avoiding or minimizing contact of the bristles with the floor. Furthermore, casing 30 could be adapted to only partly cover the bristles compacting them, for example if they are of the stiff type, and thus not in need of total protection against deformation.

Casing 30, moreover, surrounds and covers the batten, the sleeve and a portion of the stick, being of substantially flat shape so as to match the outer shape of the broom and exhibiting two opposing front sides 31 a little larger than batten 11 and joined by sides 32. At the top thereof, the casing 30 tapers to form a neck 33 adapted for surrounding the stick 20 and the sleeve 21.

Neck 33 is provided with a tubular element 34 therein that extends towards the bottom of casing 30 and which represents the sliding and locking guide of the casing along the broom. The tubular element 34 ends into the casing at the bottom of element 34 with an annular stopping tooth 35 directed inwardly toward the centre of the element itself. Tooth 35 cooperates with two annular projections obtained on sleeve 21, respectively an annular top projection 25 obtained in the proximity of and a little below the annular abutment 23 so as to engage the stopping tooth 35 in the space therebetween and lock casing 30 in the raised position so as to free the bristles and allowing the broom to be used. In the proximity of the second end 24 of sleeve 21 there is provided an annular bottom projection 27 adapted for holding the stopping tooth 35 and for locking it into the space between the bottom projection 27 and collar 14, thereby locking the casing in the lowered position for closing, protecting the bristles and relieving the broom weight on the casing.

Figure 7:
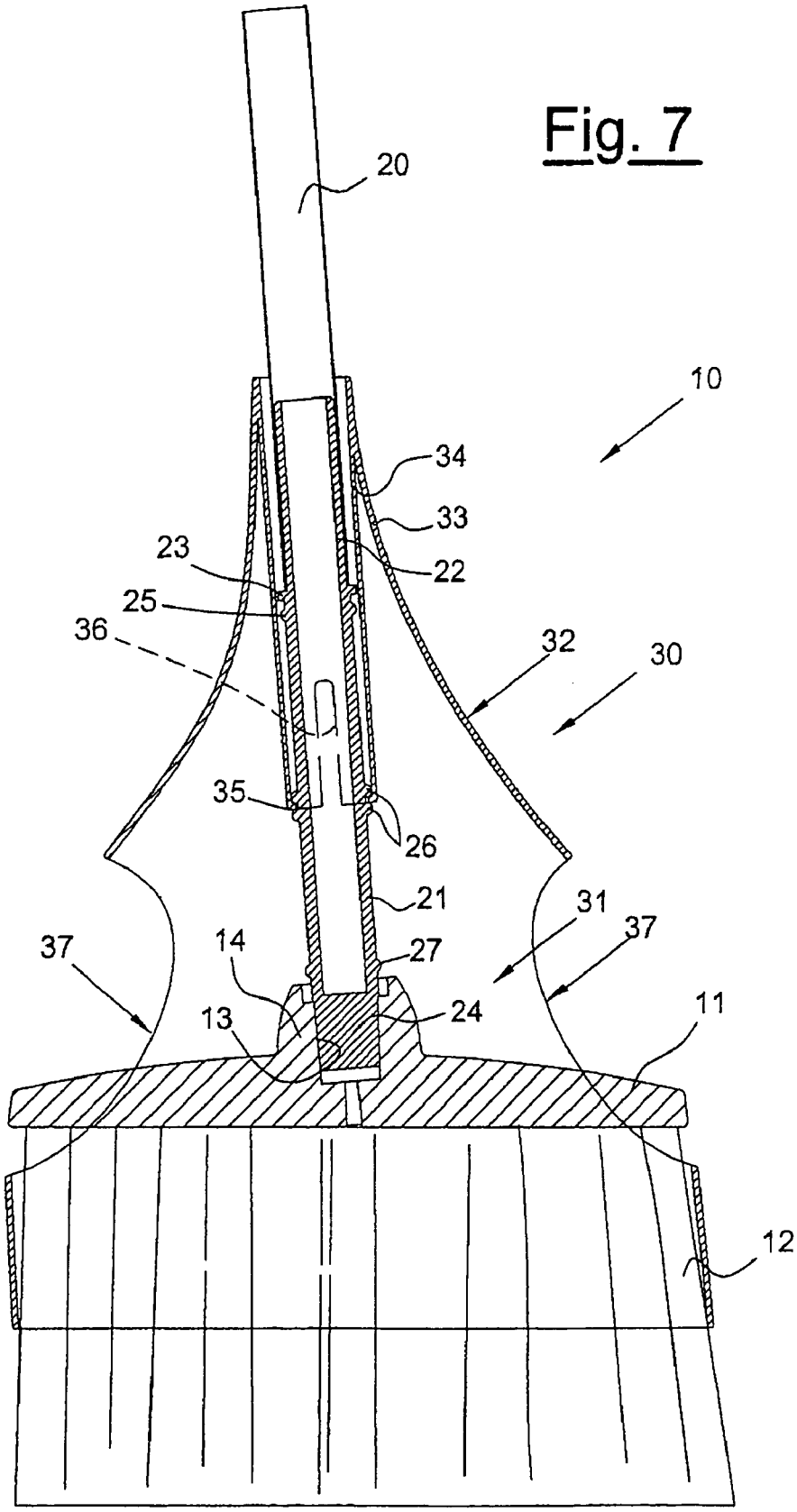
FIG. 7 is a cross-sectional view of a second embodiment of the broom according to the present invention.

According to the embodiment shown in FIG. 7, on sleeve 21, moreover, there is provided an intermediate projection 26 shaped as a dual ring positioned substantially centrally between the top and bottom projections 25 and 27 for locking casing 30 in a partly lowered position. Advantageously, this embodiment can always be present in the sleeve so as to allow the interchangeability of brooms with hard bristles and brooms with soft bristles, and/or for allowing a further position with partly free bristles.

To promote the engagement and release operation of the stopping tooth 35 with projections 25, 26, 27, the end portion of tubular element 34 is interrupted by at least one notch 36 and preferably two symmetrical notches 36. Advantageously, in order to air the bristles when the broom is in the closed position, the casing can be provided with openings 37 at the sides that include a portion of the front sides 31 and sides 32 so that when the casing is in the closed position, the end portions of batten 11 and a portion of bristles 12 are open and exposed.

While lowering casing 30, the latter, which is made a little larger than the batten so as to surround it while remaining in contact therewith, compacts and shrinks the bristles so as to reshape them if they have partly deformed during use.

The broom can advantageously exhibit batten 11 and stick 20 not perpendicular but slightly inclined so as to allow better ergonomic position of use, in this case casing 30 is also shaped so as to match such inclination.

From the description above made with reference to the drawings, it is clear that a broom according to the present invention is especially useful and advantageous. The object mentioned in the invention preamble is thus achieved.

What is claimed is:

1. A broom (10) comprising a stick (20), a shaped batten (11) having a top side (11') and a bottom side (11"), bristles (12) adapted for sweeping surfaces extend from the bottom side (11") of said batten (11), said stick (20) being insertable on the top side (11') of said batten (11), and a casing (30) formed in the shape of a shell, shaped so that in a first lowered position the casing covers said bristles (12) by at least a portion of the length thereof, and in a second raised position of the casing, use of the broom for sweeping is allowed, wherein said stick (20) has a tubular shape and is inserted on the batten (11) by the interposition of a sleeve (21) having a first end (22) adapted to have a portion inserted into the stick (20) up to an annular abutment (23), extending circumferentially from the sleeve (21), acting as a stop, and a second end (24) of the sleeve (21) opposite to said first end (22) is threaded so as to be threadably received in threaded seat (13) provided in a collar (14) protruding centrally from the top side (11') of batten (11).

2. The broom (10) according to claim 1, wherein said casing (30) is slideably received on said sleeve (21).

3. The broom (10) according to claim 2, wherein said casing (30) is of substantially flat shape so as to match the outer shape of said batten (11) and exhibits two opposing front sides (31) a little larger than the batten (11) and joined by sides (32).

4. The broom (10) according to claim 3, wherein said casing (30) is tapered at the top to form a neck (33) adapted for surrounding the stick (20) and the sleeve (21), said neck (33) having a tubular element (34) therein extending towards the bottom of the casing for forming a sliding and locking guide means for the casing along the broom.

5. The broom (10) according to claim 4, wherein the tubular element (34) ends in said casing with an annular stopping tooth (35) directed inwardly of the element, adapted for separately cooperating with annular projections obtained on the sleeve (21), respectively an annular top projection (25) obtained in the proximity of and a little below the annular abutment (23) so as to engage the stopping tooth (35) in the space therebetween so as to lock the casing (30) in the raised position, and a bottom annular projection (27) provided in the proximity of the second end (24) of the sleeve (21) for holding the stopping tooth (35) and lock it into the space between said bottom projection (27) and said collar (14), thereby locking the casing (30) in the lowered position for closing and protecting the bristles (12).

6. The broom (10) according to claim 5, wherein said sleeve (21) is further provided with an intermediate projection (26) shaped as a dual ring disposed substantially centrally between said top and bottom projections (25 and 27) for locking the casing (30) in a partly lowered position.

7. The broom (10) according to claim 5, wherein the end portion of tubular element (34) of said casing (30) is interrupted by at least one notch (36).

8. The broom (10) according to claim 7, wherein said casing (30) is provided with lateral openings (37) that include a portion of the front sides (31) and of the sides (32).

9. The broom (10) according to claim 8, wherein batten (11) and the stick (20) are inclined relative to each other and said casing (30) is shaped so as to match such inclination.

* * * * *